US005475998A

United States Patent [19]

Raskevicius et al.

[11] Patent Number: 5,475,998

[45] Date of Patent: Dec. 19, 1995

[54] LOCK ASSEMBLY WITH LOCKING BAR

[75] Inventors: Leo Raskevicius, North Haven; Paul DeMarseilles, Branford, both of Conn.

[73] Assignee: Sargent Manufacturing Company, New Haven, Conn.

[21] Appl. No.: 250,473

[22] Filed: May 27, 1994

[51] Int. Cl.[6] ..... E05B 27/00

[52] U.S. Cl. ..... 70/495; 70/493; 70/358

[58] Field of Search ..... 70/493–496, 358

[56] References Cited

U.S. PATENT DOCUMENTS

| | | | |
|---|---|---|---|
| 1,669,115 | 5/1928 | Anakin . | |
| 1,685,154 | 9/1928 | Edwards . | |
| 2,292,515 | 8/1942 | George | 70/363 |
| 2,426,104 | 8/1947 | Johnstone | 70/421 |
| 2,862,380 | 12/1958 | Welch | 70/366 |
| 3,286,494 | 11/1966 | Sussina | 70/419 |
| 3,393,542 | 7/1968 | Crepinsek | 70/358 |
| 3,621,688 | 11/1971 | Asmar et al. | 70/352 |
| 3,722,240 | 3/1973 | Spain et al. | 70/364 |
| 3,742,744 | 7/1973 | Lumme | 70/358 |
| 3,837,197 | 9/1974 | Lopez | 70/364 |
| 3,999,413 | 12/1976 | Raymond et al. | 70/364 |
| 4,185,480 | 1/1980 | Pechner | 70/358 |
| 4,221,121 | 9/1980 | Tietz | 70/358 |
| 4,404,824 | 9/1983 | Hennessy | 70/495 |
| 4,434,636 | 3/1984 | Prunbauer | 70/358 |
| 4,446,709 | 5/1984 | Steinbach | 70/496 |
| 4,478,061 | 10/1984 | Preddey | 70/358 |
| 4,603,565 | 8/1986 | Strassmeir | 70/358 |
| 4,608,842 | 9/1986 | Tietz | 70/358 |
| 4,723,427 | 2/1988 | Oliver | 70/364 |
| 4,756,177 | 7/1988 | Widen | 70/364 |
| 4,815,307 | 3/1989 | Widen | 70/493 |
| 5,067,335 | 11/1991 | Widen | 70/495 |
| 5,079,936 | 1/1992 | Stefanek | 70/358 |
| 5,205,143 | 4/1993 | Hakkarainen et al. | 70/366 |
| 5,209,087 | 5/1993 | Cox | 70/495 X |

*Primary Examiner*—Steven N. Meyers
*Assistant Examiner*—Monica E. Millner
*Attorney, Agent, or Firm*—DeLio & Peterson

[57] ABSTRACT

A lock assembly includes a cylindrical key plug with a key slot and a shell surrounding the plug. A first locking mechanism is provided by split top pins projecting across the shear surface interface between the plug and the shell and are positioned to align the split with the shear surface by notches of varying height located along the top of a key. Second and preferably third locking mechanisms are also located in the plug and include a locking bar that projects into a locking groove in the shell when in the locked position. The locking bar has an offset ridge along an upper edge that prevents the locking bar from moving to an unlocked position unless side pins having recesses adapted to receive the ridge are properly positioned by depressions of the correct depth along the side of the key to align the recesses with the ridge. The lock can be easily rekeyed by simply reversing the locking bar.

20 Claims, 4 Drawing Sheets

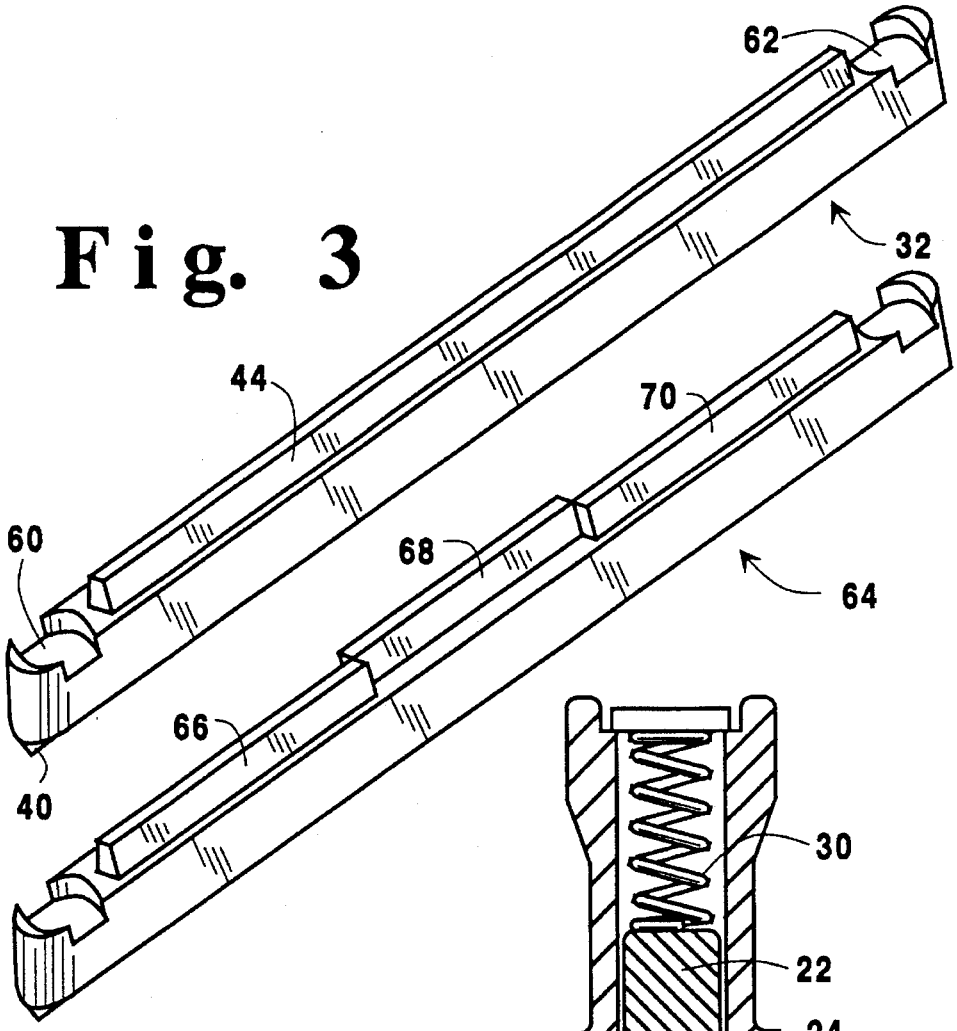
Fig. 3
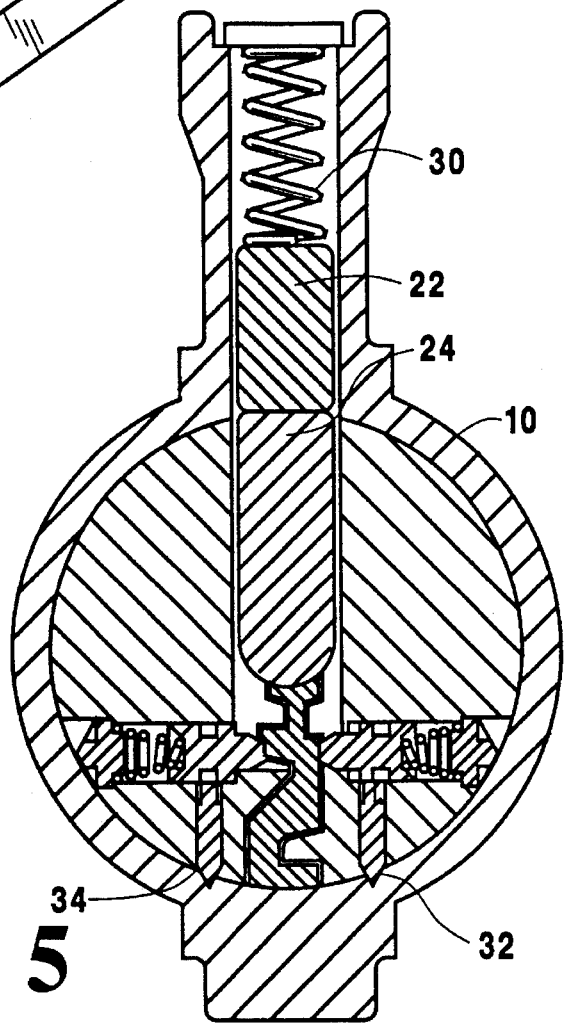
Fig. 4
Fig. 5

LOCK ASSEMBLY WITH LOCKING BAR

BACKGROUND OF THE INVENTION

1. Field of the Invention

This invention relates to cylinder locks of the type having a shell surrounding a cylindrical key plug which is rotated by a key received in the plug to actuate the lock. More specifically, the invention relates to such locks in which the key operates two or more independent locking mechanisms before the key plug can be rotated.

2. Description of Related Art

Cylindrical locks have a cylindrical shell surrounding a cylindrical key plug with a longitudinal key slot or keyway formed therein adapted to receive a key of a particular configuration. The interface between the key plug and the shell forms a shear surface and the key plug is prevented from rotating by the locking mechanism which projects a series of locking elements across the shear surface, preventing it from rotating until the correct key is inserted.

In a conventional cylindrical lock, there is a single locking mechanism in which the locking elements are a series of spring driven segmented pins (referred to herein as the top pins) having upper and lower halves received in top pin bores which project across the shear surface.

Generally, the upper half of each top pin extends across the shear surface whenever the key is removed from the lock to prevent the key plug from rotating. Notches of varying depth along the top of the correct key lift the top pins to the desired height to align the joint between the upper and lower half of each top pin with the shear surface. The key plug can then be rotated with the lower half of each top pin rotating with the key plug and the upper half remaining stationary with the shell.

The depth of the notches along the top of the key define a key code for the lock, and only keys having that code, i.e., only keys having notches of the correct depth in the proper sequence will move the top pins to the correct predetermined position to allow the plug to rotate. The key slot is generally shaped with a series of longitudinal wards which match corresponding wards on the key.

Locks of this conventional type are widely used, but all have limitations in the number of available combinations of the locking codes, the resistance to picking, the resistance to forcible entry and the limited security afforded due to widely available key blanks and duplicating equipment for these conventional locks.

The present invention provides a significantly improved level of security by adding one or more additional locking mechanisms to the primary locking mechanism of the type described above. The secondary (or tertiary, etc.) locking mechanisms are operated by corresponding locking codes cut in the form of depressions of varying depth along the sides of the key. The additional locking codes are particularly advantageous in constructing a family of locks in which all members of each family have an identical secondary or tertiary locking code and vary only in the primary code corresponding to the notches in the key.

This allows the owner of a number of related locks, for example a hotel owner locking hotel rooms, or a marina owner locking storage areas, to be assigned a unique secondary locking code (or a secondary/tertiary locking code combination) for all of his keys. The unique secondary code is cut into key blanks with specialized equipment. The primary locking code may be cut into the blanks with conventional equipment.

The additional locking mechanisms also provide additional pick resistance through the use of side pins which engage the depressions forming the secondary locking code on the key and superior resistance to forced operation through the use of one or more locking bars actuated by the side pins.

Beyond the improvements in pick resistance, forcible operation resistance, and increased locking code combinations, it is an object of the invention to keep the additional locking mechanisms as small as possible so that additional space remains in the key plug for other locking mechanisms of the same or different designs.

It is yet another object of the present invention is to provide a design in which the additional locking codes may be quickly and easily changed in the field.

A further object of the present invention is to provide a lock design in which the additional locking codes may be changed using only the original lock components, without requiring any new pieces. A particular advantage of the present invention is that the code may not only be changed in the field, it may be changed several times without the need to remove or replace any of the pins used in the secondary locking mechanism, which is a common source of error when rekeying large numbers of locks.

An even greater advantage is that the secondary codes may all be changed very quickly to alter the secondary codes in a reliably predetermined manner so that the owner of multiple locks may be provided with a new unique secondary code for all his keys. The new keys must be encoded with the new secondary (or secondary/tertiary) code, but retain their original primary code. To prepare the new keys, it is simply necessary to copy the primary code of the original keys onto the new key blanks provided with the new secondary/tertiary code. This can be done with widely available conventional key cutting machines once the new blanks are provided.

Even more advantageously, the present design allows the secondary/tertiary codes to be changed so that the original keys may be used and the new secondary tertiary codes cut into the original keys by deepening certain of the depressions forming the additional codes.

Still other objects and advantages of the invention will in part be obvious and will in part be apparent from the specification.

SUMMARY OF THE INVENTION

The present invention comprises a lock assembly having a key plug surrounded with a cylindrical shell. The key plug has a key slot which accepts a key, preferably provided with a longitudinal wards matching corresponding wards in the key slot. Primary locking of the key plug is provided with conventional split top pins driven by top pin springs and sliding within top pin bores that extend across the shear surface between the key plug and the shell.

At least one additional locking mechanism is provided by one or more side pins sliding within side pin bores that project from the outer surface of the key plug to the key slot. The bores are arranged such that the axis of the bore projects into the portion of the key slot occupied by the lower half of the key. Depressions of varying depth are cut into the key, and the side pins are pushed into these depressions by side pin springs. Each side pin and its corresponding spring is held within the corresponding side pin bore by a cover and the entire assembly comprising the cover, spring and side pin is located within the key plug.

The terms "side pins" and "top pins" are used herein for convenient reference only. It will be readily understood that the lock assembly can be used with the "top" pins oriented in any desired radial direction, for example, to position them on the bottom or side of the lock assembly.

The depth to which a side pin projects into the key slot is determined by the depth of the depression in the key. A recess is formed in the exterior surface of the side pin which receives a ridge formed on the upper surface of a locking bar sliding in a locking bar slideway between the exterior surface of the key plug and the side pin bore.

The locking bar slides between a locked position in which the locking bar extends across the shear plane into a locking groove formed in the interior surface of the shell and an unlocked position in which the ridge on the locking bar enters the recess in the side pin. The locking bar has a width between the upper surface near the side pins and the lower surface near the locking groove that is sufficient to prevent it from moving out of the locking groove until the ridge on the bar can move into the recesses on the side pins. This cannot happen unless the side pins are in the proper predetermined position defining the second locking code.

By extending across the shear surface, the locking bar prevents the key plug from rotating whenever a key is not inserted in the key slot or whenever a key having the incorrect second code is inserted into the key slot. Only when a key containing the proper second code with depressions of the correct predetermined depth is inserted in the key slot can the side pins project to the proper depth and line their recesses up with the ridge on the locking bar permitting it to move out of the locking groove in the shell when the key plug is rotated. To improve pick resistance, the locking bar is spring driven toward the cylinder shell.

The side pin bores are preferably oriented at 90° to the plane of the key and the locking bar slideway is preferably oriented at 90° to the plane of the side pins, i.e. parallel to the plane of the key. This arrangement results in a very compact structure for the additional locking mechanism which may be entirely located in one quadrant of the cylindrical key plug, i.e., below the horizontal plane passing through the axis of the plug and to one side of the vertical plane through that axis.

The resulting design is sufficiently compact that it may be duplicated on both sides of the key to provide secondary and tertiary locking codes, and still leave the entire upper two quadrants of the key plug free for the primary locking mechanism, possibly with fourth and/or fifth locking mechanisms.

In the most highly preferred embodiment of the invention, the locking bar is symmetrical about a plane passing through its center, perpendicular to the lengthwise axis of the bar, and the ridge on the locking bar is offset from the centerline of the locking bar. The ridge may be continuously offset along its entire length, or only a portion of it may be offset, and different portions may be offset by different amounts. This offset ridge/symmetrical design permits the locking bar to be easily removed and reversed by a locksmith in the field to provide a new secondary or tertiary locking code. By reversing the locking bar, the distance between the key plane and the ridge is changed requiring a new depth for the depressions in the key.

BRIEF DESCRIPTION OF THE DRAWINGS

For a fuller understanding of the invention, reference should be made to the following description taken in connection with the accompanying drawings, in which:

FIGS. 3 and 4 are perspective views of two alternative embodiments of the locking bar showing different arrangements for the offset ridge of the locking bar.

FIG. 5 is a cross-sectional view corresponding to the preferred embodiment of the invention shown in FIG. 1 except that the right locking bar has been reversed and a key with tile incorrect locking code has been inserted.

DESCRIPTION OF THE PREFERRED EMBODIMENT(S)

Figure 1:
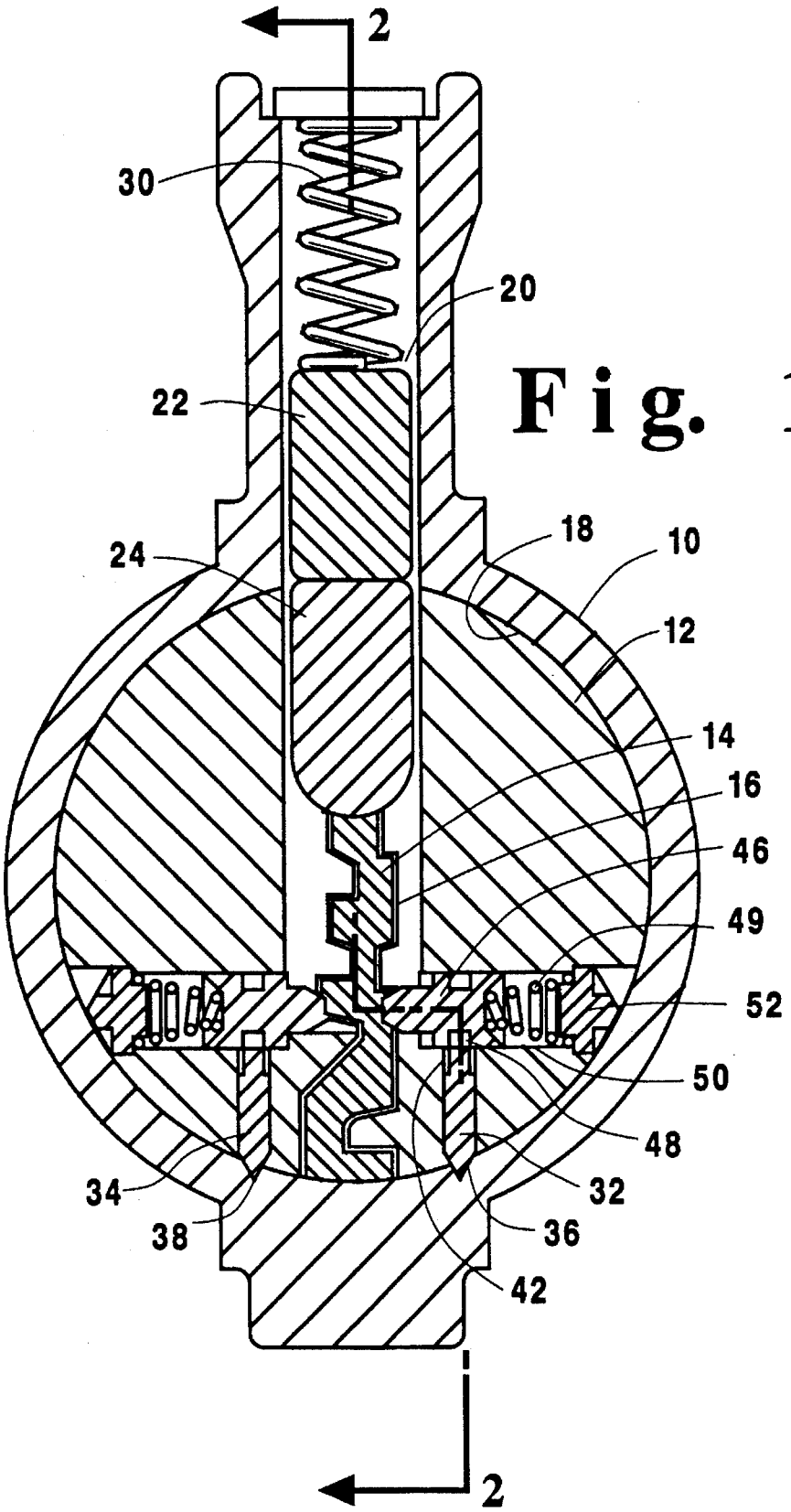
FIG. 1 is a cross sectional view of the preferred embodiment of the invention taken perpendicular to the axis of the key plug, along the line 1—1 in FIG. 2.

In describing the preferred embodiment of the present invention, reference will be made herein to FIGS. 1–7 of the drawings in which like numerals refer to like features of the invention. Features of the invention are not necessarily shown to scale in the drawings.

Figure 2:
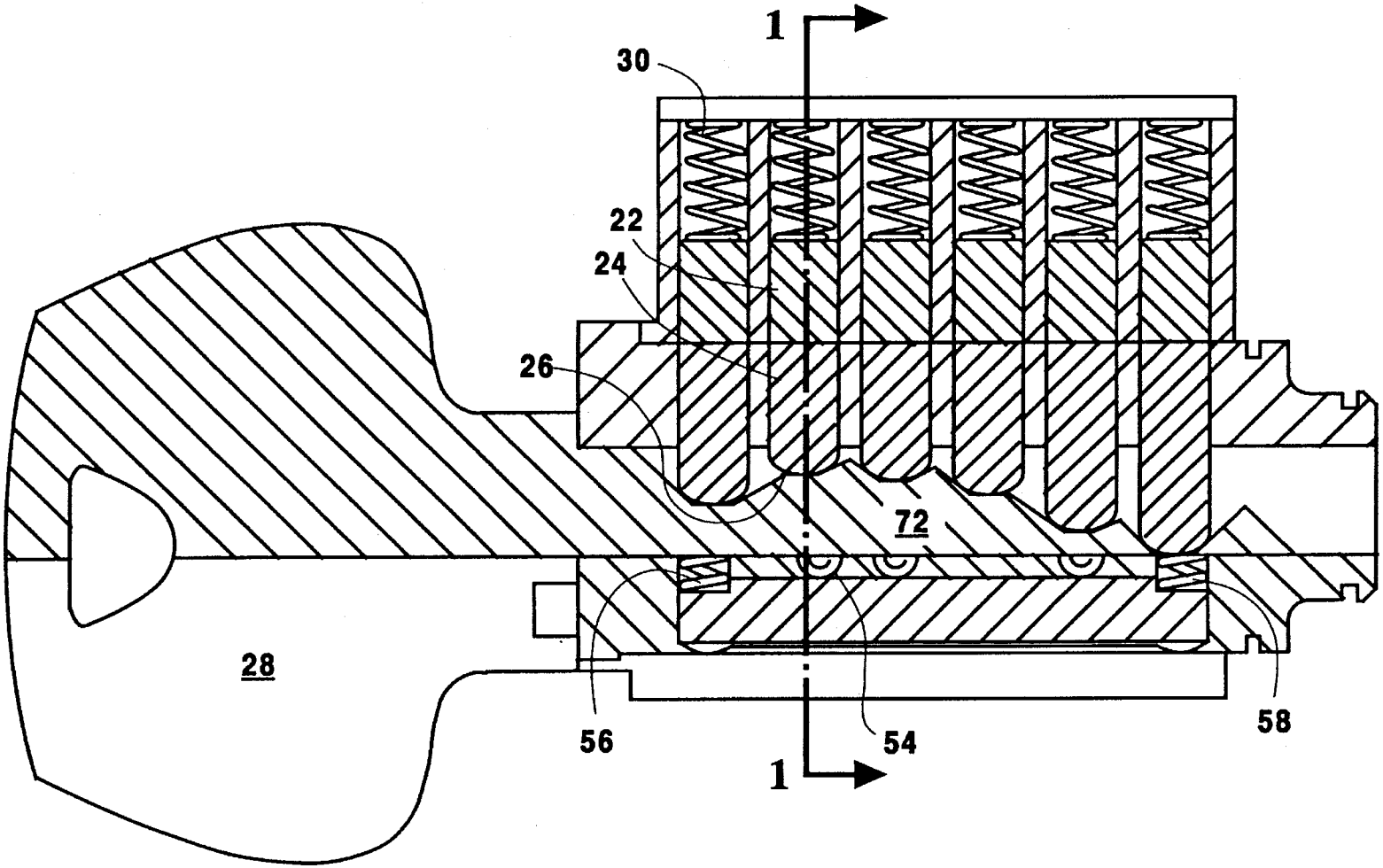
FIG. 2 is a cross-sectional view of the preferred embodiment of the invention taken along the line 2—2 in FIG. 1. Note that line 2—2 in FIG. 1 extends partly through the vertical key plane and partly through the center of a locking bar, offset from the key plane, to better illustrate the invention.

Referring principally to FIGS. 1 and 2, the present invention comprises a shell 10 with a cylindrical inner surface surrounding a cylindrical key plug 12. The key plug rotates about its axis within the shell whenever a key 14 having the correct locking codes cut into its surface is inserted into the key slot 16.

The cylinder of contact between the exterior surface of the key plug 12 and the interior surface of the shell 10 defines a shear surface 18. The key plug on the inner side of the shear surface must move relative to the shell on the outer side of that surface during the unlocking action, and this relative motion is prevented by three locking mechanisms, described more particularly as the top pins 20 and locking bars 32 and 34, which keep the assembly locked until they are moved to a position that clears the shear surface and allows the rotation of the key plug.

Referring to FIG. 2, it can be seen that the first locking mechanism is formed by a set of six top pins located along the upper portion of the key. The pins are identical, except for the length of the lower half of each pin. Accordingly, only top pin 20 through which the cross sectional view of FIG. 1 is taken will be described. The position and lengths of the lower halves of the top pins define a first locking code encoded into the notches 26 of varying heights formed along the upper surface of the key 14.

Top pin 20 is composed of an upper half 22 and a lower half 24. When a key having the correct notch height 26 is inserted into the key slot, the junction between the upper half 22 and the lower half 24 of the top pin is aligned with the shear surface 18 permitting the key plug to rotate. Top pin spring 30 operates conventionally to push the upper half 22 of the top pin 20 across the shear surface when the key is removed and lock the key plug relative to the shell.

Although FIG. 2 illustrates six top pins, more pins or fewer top pins may also be used, as may any of many different variations of conventional designs for the top locking pin. Such variations include splitting the top pin into more than two portions to accommodate master keying, varying the shapes and dimensions of the top pins to make it more difficult to pick the lock, etc.

The second and third locking mechanisms are located in the lower right and lower left quadrants of the key plug seen in FIG. 1. The locking action is performed by locking bars 32 and 34 which slide across the shear surface 18 into corresponding locking grooves 36, 38 formed in the shell 10. Locking bar 32, seen best in the perspective view of FIG. 3, is pushed into its locking groove 36 by a pair of springs 56, 58 (see FIG. 2) pressing between the plug 12 and the locking bar at points 60, 62.

The locking groove 36 is formed with upwardly angled sides which correspond to the angled bottom edge 40 of the locking bar. With the correct key inserted, the key plug 12 can be rotated and the lower edge 40 of the locking bar 32 rides up the angled sides of the locking groove 36, compressing springs 56 and 58 and sliding into its corresponding locking bar slideway 42, clear of the shear surface.

With the incorrect key inserted, or no key inserted, the locking bar 32 is prevented from retracting into its locking bar slideway 42 by one or more side pins which extend across the top of the slideway. The cross sectional view in FIG. 1 shows side pin 46 having a recess 48. There will typically be at least one, and preferably two additional side pins that are essentially the same as side pin 46, except for the location of the recess relative to the tip of the pin. FIG. 2 shows the location of the preferred total of three side pins, whose position along the length of the key may be varied to vary the second locking code corresponding to the second locking mechanism.

The upper edge of the locking bar 32 is provided with a ridge 44 (see FIG. 3) which cooperates with recess 48 formed on the exterior surface of side pin 46 to control the motion of the locking bar 32 between the locked and the unlocked position. Before the locking bar 32 can move into the unlocked position, recess 48 must be aligned with ridge 44. Provided that the remaining side pins are also in the correct predetermined positions to receive the ridge 44 in their corresponding recesses, the locking bar can move into the unlocked position with the lower edge 40 of the locking bar clear of the shear surface 18.

Side pin 46 is spring loaded with spring 48 to slide towards the key slot 16 in the side pin bore 50. Spring 49 is held in place by cover 52 which is press fitted, staked or otherwise secured in the side pin bore. The side pin bore 50 defines a bore axis which is preferably oriented at right angles to the plane of the key. The tip of the side pin 46 projects into the key slot and is contacted by the key. A depression 54 is cut in the key (see FIG. 2) and the depth of this depression controls the location of the side pin 46.

If the key is missing, or the depression is bored too deeply, the side pin 46 will extend too far into the key slot and the recess 48 will not be aligned with the ridge 44 on the locking bar 32. Alternatively, if a key is inserted without a depression bored in the appropriate location, or the depression is too shallow, the side pin 46 will be pushed too far out of the key slot 16, again misaligning the recess 48 and the ridge 44. Only when the proper depth for each depression is provided in the proper locations will the side pins be positioned to the proper depth to allow the locking bar 32 to slide into its unlocked position.

The location of the depressions along the right lower side of the key 14, and the depth of those depressions determines the second locking code cut into the key. The third locking code is cut in a corresponding manner into the left lower side of the key to control the side pins on the left side of the key.

The location of recess 48 along the exterior surface of side pin 46 may be varied to vary the distance between the tip of the side pin and the recess. As this distance is varied, the depth of the depression 54 must also be varied to align the ridge 44 and the recess. For example, there may be two types of standard side pins used. The first type may have a shorter distance between the tip of the pin and the recess and the second type may have a longer distance between the tip of the pin and the recess. When the shorter spacing pin is inserted into the side pin bore, the depression 54 must be shallow and when the longer spacing pin is used, the depression 54 must be bored more deeply. If the longer spacing type of side pin is used, any key inserted with a shallow depression or no depression bored at location 54 will fail to align the recess on the side pin with the ridge and prevent the locking bar 32 from sliding to the unlocked position.

Depending upon the size of the lock and the tolerance to which the components can be constructed, it may be possible to use side pins which have three or more different standard locations for the recess resulting in a greater number of combinations for the unlocking code corresponding to the side pins.

Referring to FIG. 2, in the embodiment illustrated therein it can be seen that there are six locations for top pins. There are also six corresponding possible locations for side pins (although more or fewer possible locations may be used if desired). There are also an additional six side pin locations corresponding to the opposite side of the key and the third locking mechanism using locking bar 34.

Unlike the top pins where a top pin is inserted in each top pin bore, it is expected that only some of the side pin bores will be filled with side pins and springs. This increases the number of locking codes because each position may now have three possible configurations: a shallow depression (corresponding to a pin with a shorter tip to recess distance), a deep depression (corresponding to a pin with a longer tip to recess distance), and no depression (corresponding to no side pin). Additional variations in the depth of the depression may be used when different side pins (having more than 2 standard recess locations) or when offset ridges (described below) are used.

Regardless, all of the side pins must be properly positioned with their respective recesses properly aligned in order for the locking bar to move to the unlocked position.

Referring to FIG. 3, it can be seen that the ridge 44 on the locking bar 32 is offset from the centerline of the locking bar. This offset can also be seen in FIG. 1 where the ridge is offset away from the key slot on locking bar 32 and is offset towards the key slot on locking bar 34. Moreover, the locking bar is made symmetrical about a plane perpendicular to its longitudinal axis through the center of the bar. This permits the locking bar to be inserted in either of the two orientations shown in FIG. 1, namely with the ridge offset towards or away from the key slot.

As a result, the second or third locking codes can be changed quite easily in the field simply by removing locking bar 32 or 34 and reversing it lengthwise before reinserting it into its locking slot. All of the original keys will now fail to function in the lock due to this change. The original keys will align the side pins with their recesses at the original location which is no longer aligned with the ridge on the reverse locking bar.

An advantage to this technique is that the locking bars may initially be inserted with the offset oriented away from the key slot. Upon the first change in the keying system, the locking bar 32 may be reversed (changing only the second locking code) and authorized key holders may have their keys modified simply by increasing the depth of the depressions on the right lower side of their preexisting keys. Upon the second change to the system, locking bar 34 may be reversed and the authorized key holders may still retain their original keys providing they are modified by increasing the depth of the depression on the left side of the key.

It may be seen that there are two different positions for each of the two locking bars resulting in a total of four combinations which may easily be selected in the field. Each of these four combinations may be selected without removing any of the side or top pins, and without any additional components for the lock.

Those familiar with the art will also see that other locking codes may be devised by making other changes in the location of the ridge. For example, the locking bar 32 seen in FIG. 3 may be replaced with the locking bar 64 seen in FIG. 4. In this design, the ridge is divided into three sections 66, 68 and 70 and the outer two sections 66 and 70 are offset in one direction and the central section 68 is offset the same distance from the centerline, but in the opposite direction. Division of the ridge into a different number of sections, e.g., into a different offset direction for each possible side pin location is also possible.

In the locking bars shown in FIGS. 3 and 4, the offset distance is the same. Depending upon the size of the lock and the tolerance to which it is constructed, different locking bars can be used with different standardized offset distances. For example, a ridge may have a single standardized offset distance as shown (reversible to provide two different sets of locking codes), a centered location and one offset distance from that center (reversible to provide three different sets of locking codes), or two different standardized offset distances (reversible to provide four different sets of locking codes), etc.

FIG. 5 illustrates the lock with two offset locking bars 32 and 34 inserted with both being oriented with the offset towards the key slot. An incorrect key is shown inserted in the lock in FIG. 5 with no depression at the corresponding location to side pin 46 resulting in the misalignment of the side pin recess 48 and the ridge 44. Accordingly, the side pins occupy the space within the side pin bores needed by the ridge to allow the locking bar to move out of the locking groove.

Figure 6:
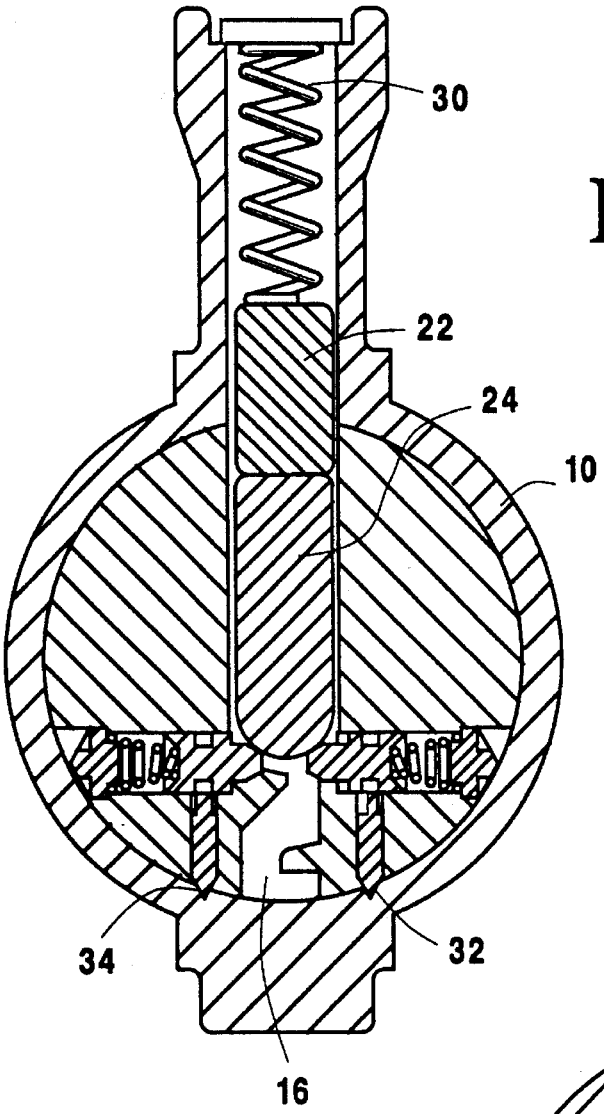
FIG. 6 is a cross-sectional view corresponding to the preferred embodiment of the invention shown in FIG. 1 except that the key has been removed.

In FIG. 6 the lock of FIG. 1 is illustrated with a key removed. Notice that all three locking points are locked. The upper half of the top pin 22 extends across the shear surface and the right and left side pins are misaligned with the locking bars 32 and 34, securing them in the locked position. This provides excellent security against forcible operation of the lock. The length of the locking bars acting against the sides of the locking grooves provides a large resistive surface to the application of force attempting to rotate the lock without the key.

Figure 7:
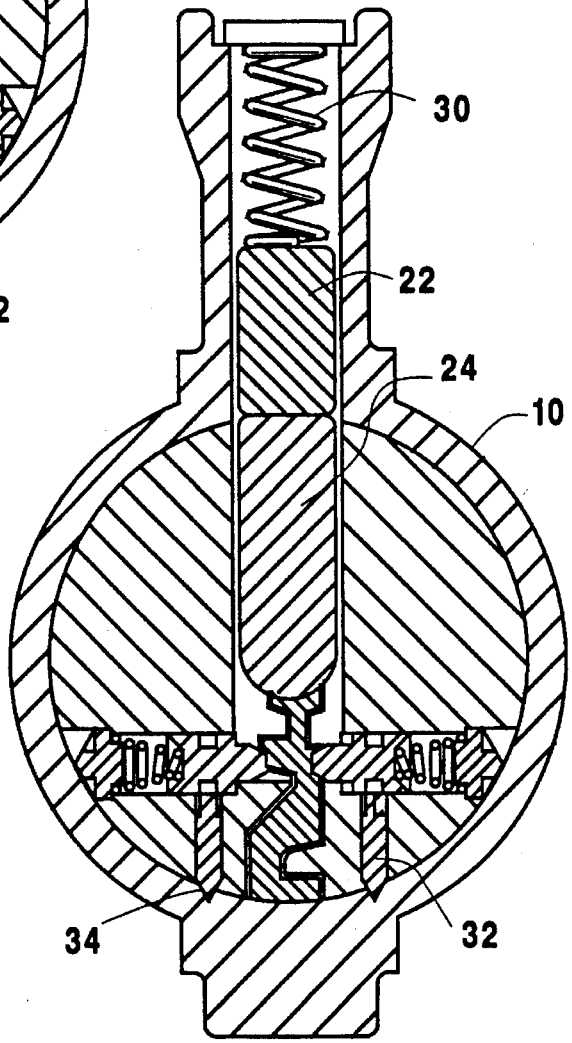
FIG. 7 is a cross-sectional view corresponding to the preferred embodiment of the invention shown in FIG. 1 except that the right locking bar has been reversed and a different key, with the correct locking code for the reversed locking bar has been inserted.

FIG. 7 corresponds to FIG. 5 with the locking bars 32 and 34 oriented with the offset ridge toward the key slot. The correct key for the reversed locking bar has been inserted.

From the above description will be apparent that the key 14 comprises a key bow 28 and a key blade 72. The key blade is provided with a plurality of ridges of varying heights on the upper surface of the blade defining a first locking code, a plurality of depressions on the lower right side of the blade defining a second locking code and a plurality of depressions on the lower left side of the blade defining a third locking code.

Due to the compact construction of the second and third locking mechanisms, the entire upper half of the key plug is available for construction of the first and/or additional locking mechanisms. For example, it is known to use additional split top pins having a relatively small diameter in varying angles from the vertical. In some extremely high security application it may be desirable to have three or more sets of split top pins arranged in the upper two quadrants of the key plug with the second and third mechanism described above in the lower two quadrants of the key plug.

A cost effective feature of the invention is that the offset ridges on the locking bars may initially be positioned at the maximum distance from the key. When the locking code is changed by reversing the locking bar, the original keys are disabled, but they may be conveniently reactivated by simply deepening the depressions on the lower right side of the preexisting keys. During a second rekeying operation, the locking bar 34 may be reversed with the depressions on the left side of the key deepened.

If more than a total of two rekeying operations are desired without the necessity of replacing keys, the initial rekeying may be performed by replacing the locking bars with a locking bar having only a section of the outwardly offset ridge moved to the inward offset position, etc. Other permutations and combinations will be apparent to those familiar with the art.

The two locking grooves 36, 38 may be conveniently constructed in the interior of the shell by broaching. The side pin bores may be drilled, and generally all the side pin bores will be drilled even if all the side pin bores are not filled with corresponding side pins.

Although the invention has been shown in the preferred design in which the axis of the side pin bores is perpendicular to the plane of the key, the side pin bores may also be oriented at an angle to the plane of the key and the orientation of the locking bars may also be changed correspondingly.

It will thus be seen that the objects set forth above, among those made apparent from the preceding description, are efficiently attained and, since certain changes may be made in the above construction(s) without departing from the spirit and scope of the invention, it is intended that all matter contained in the above description or shown in the accompanying drawing(s) shall be interpreted as illustrative and not in a limiting sense.

Thus, having described the invention, what is claimed is:

1. A lock assembly comprising:

a shell having an inner surface and a locking groove longitudinally formed therein;

a key plug fitted within the shell for rotational motion therein, the key plug having a front surface and an exterior surface defining a shear surface with the inner surface of the shell;

a key slot extending from the front surface of the key plug longitudinally into the key plug;

a top pin bore extending from the shell across the shear surface and into the key plug;

a top pin having an upper half and a lower half located in the top pin bore;

a top pin spring located in the top pin bore and urging the top pin across the shear surface to prevent rotation of the key plug when a key is not in the key slot;

a plurality of side pin bores formed in the key plug, each of the side pin bores defining an axis extending substantially perpendicular to the key slot;

a plurality of side pins, each of the side pins having an exterior surface with a recess formed therein, and each of the side pins being fitted within a corresponding one of the side pin bores for sliding motion therein;

a locking bar slideway formed in the key plug extending from the exterior surface of the key plug to the plurality of side pin bores;

a one piece locking bar having a ridge, the width of the ridge being less than the width of the locking bar, the locking bar being held in the locking bar slideway for sliding motion perpendicular to the locking groove between a locked position in which the locking bar extends into the locking groove and an unlocked position in which the ridge on the one piece locking bar simultaneously enters the recesses in the plurality of side pins, the ridge preventing the locking bar from moving to the unlocked position unless the side pins are in a predetermined position aligning the recesses on the side pins with the ridge; and at least one locking bar spring for moving the locking bar within the locking bar slideway perpendicular to the locking groove.

2. A lock assembly according to claim 1 wherein the key slot defines a key plane and the slideway is parallel to the key plane, the locking bar sliding transversely to the key plug and parallel to the key plane between the locked position and the unlocked position.

3. A lock assembly according to claim 1 wherein the ridge of the locking bar is offset from a centerline of the locking bar.

4. A lock assembly according to claim 3 wherein the locking bar is reversible, the slideway accepting the locking bar when reversed and the reversed offset ridge defining a new predetermined position for the side pins to align the reversed ridge with the recesses.

5. A lock assembly according to claim 1 further including a plurality of side pin springs located in the side pin bores for urging the side pins towards the key slot.

6. A lock assembly according to claim 1 further including:

an additional locking groove longitudinally formed in the shell;

an additional side pin bore in the key plug extending into the key slot;

an additional side pin having an exterior surface with a recess formed therein, the additional side pin being fitted within the additional side pin bore for sliding motion therein;

an additional locking bar slideway formed in the key plug on an opposite side of the key slot from the first locking bar slideway, the additional locking bar slideway extending from the exterior surface of the key plug to the additional side pin bore; and an additional locking bar having a ridge, the additional locking bar being held in the additional locking bar slideway for motion between a locked position in which the additional locking bar extends into the additional locking groove and an unlocked position in which the ridge on the additional locking bar enters the recess in the additional side pin, the ridge on the additional locking bar preventing the additional locking bar from moving to the unlocked position unless the additional side pin is in a predetermined position aligning the recess on the additional side pin with the ridge on the additional locking bar.

7. A lock assembly according to claim 6 further including side pin springs located within the side pin bores for urging the side pins towards the key slot.

8. A lock assembly according to claim 1 wherein:

the side pin bores in the key plug extend from the exterior surface of the key plug into the key slot;

the lock assembly further includes a plurality of side pin springs located in the side pin bores between the side pins and the exterior surface of the key plug; and the lock assembly further includes a plurality of side pin covers located between the side pin springs and the exterior surface of the key plug, the side pin springs acting against the side pin covers to urge the side pins towards the key slot.

9. A lock assembly according to claim 1 wherein the ridge of the locking bar includes at least two portions, at least one of said portions being offset from a centerline of the locking bar, the offset portion of the ridge entering the recess in the side pin when the locking bar is in the unlocked position.

10. A lock assembly according to claim 9 wherein the locking bar is reversible, the slideway accepting the locking bar when reversed and the reversed offset portion of the ridge defining a new predetermined position for the side pin to align the reversed ridge with the recess.

11. A lock assembly according to claim 9 wherein the locking bar includes at least three portions, two of said three portions being offset in a first direction from the centerline of the locking bar, and the other of said three portions being offset in the opposite direction from the centerline of the locking bar.

12. A lock assembly comprising:

a shell having an inner surface and first and second locking grooves formed therein;

a key plug having a key slot fitted within the shell for motion therein;

a first plurality of side pin bores on a first side of the key plug;

a first plurality of side pins having recesses formed therein fitted within the first plurality of side pin bores;

a second plurality of side pin bores on a second side of the key plug;

a second plurality of side pins having recesses formed therein fitted within the second plurality of side pin bores;

a first locking bar slideway formed in the key plug on the first side of the key plug;

a second locking bar slideway formed in the key plug on the second side of the key plug;

a first locking bar having a ridge, the width of the ridge being less than the width of the locking bar, the first locking bar being held in the first locking bar slideway for sliding motion perpendicular to the first locking groove between a locked position in which the first locking bar extends into the first locking groove and an unlocked position in which the ridge enters the recesses in the first plurality of side pins, the ridge preventing the locking bar from moving to the unlocked position unless the first plurality of side pins are in predetermined positions aligning the recesses on the first plurality of side pins with the ridge; and a second locking bar having a ridge, the width of the ridge being less than the width of the locking bar the second locking bar being held in the second locking bar slideway for sliding motion perpendicular to the second locking groove between a locked position in which the second locking bar extends into the second locking groove and an unlocked position in which the ridge enters the recesses in the second plurality of side pins, the ridge preventing the locking bar from moving to the unlocked position unless the second plurality of side pins are in predetermined positions aligning the recesses on the second plurality of side pins with the ridge.

13. A lock assembly according to claim 12 wherein the first and second plurality of side pins lie in a plane that is perpendicular to a key plane defined by the key slot and the first and second locking bars slide in directions that are perpendicular to the plane of the side pins and parallel to the key plane.

14. A lock assembly according to claim 12 wherein the ridge of the locking bars are offset from a centerline of the locking bars and the locking bars are reversible, the slideways accepting the locking bars when reversed and the reversed offset ridges defining new predetermined positions for the side pins to align the reversed ridges with the recesses thereof.

15. A lock assembly comprising:

a shell having an inner surface with a locking groove formed therein;

a cylindrical key plug having an axis and a key slot extending longitudinally into the key plug, the key plug having an outer surface defining a shear surface with the shell and the key plug being fitted within the shell for rotation therein;

a plurality of top pin bores extending from the shell across the shear surface and into the key slot;

a plurality of top pins, each of said top pins having an upper half and a lower half located in a corresponding one of the top pin bores;

a plurality of top pin springs corresponding to the plurality of top pins, each of said top pin springs being located in a corresponding one of the top pin bores and urging the corresponding top pin across the shear surface to prevent rotation of the key plug when a key is not in the key slot;

a plurality of side pin bores in the key plug extending into the key slot;

a plurality of side pins, each of said side pins having an exterior surface with a recess formed therein, each of said side pins being fitted within a corresponding one of the side pin bores for sliding motion therein;

a locking bar slideway formed in the key plug extending from the exterior surface of the key plug to the plurality of side pin bores; and a locking bar having a ridge, the locking bar being held in the locking bar slideway for motion perpendicular to the locking groove between a locked position in which the locking bar extends into the locking groove and an unlocked position in which the ridge enters the recesses in the plurality of side pins, the ridge preventing the locking bar from moving to the unlocked position unless the plurality of side pins are in predetermined positions aligning the recesses on the side pins with the ridge;

the locking bar, the locking bar slideway, the side pins, the side pin bores and the side pin springs being located in a half of the key plug that lies below the axis of the key plug.

16. A lock assembly comprising:

a shell having an inner surface with a locking groove formed therein;

a cylindrical key plug having an axis and a key slot extending longitudinally into the key plug, the key plug having an outer surface defining a shear surface with the shell and the key plug being fitted within the shell for rotation therein and the key slot defining a key plane;

a plurality of top pin bores extending parallel to the key plane from the shell across the shear surface and into the key slot;

a plurality of top pins, each of said top pins having an upper half and a lower half located in a corresponding one of the top pin bores;

a plurality of top pin springs corresponding to the plurality of top pins, each of said top pin springs being located in a corresponding one of the top pin bores and urging the corresponding top pin across the shear surface to prevent rotation of the key plug when a key is not in the key slot;

a plurality of side pin bores in the key plug extending perpendicular to the key plane into the key slot;

a plurality of side pins, each of said side pins having an exterior surface with a recess formed therein, each of said side pins being fitted within a corresponding one of the side pin bores for sliding motion therein;

a plurality of side pin springs corresponding to the plurality of side pins for urging the side pins towards the key slot;

a locking bar slideway formed in the key plug parallel to and offset from the key plane, the locking bar slideway extending from the exterior surface of the key plug to the plurality of side pin bores; and a locking bar having a ridge, the locking bar being held in the locking bar slideway for motion perpendicular to the locking groove between a locked position in which the locking bar extends into the locking groove and an unlocked position in which the ridge enters the recesses in the plurality of side pins, the ridge preventing the locking bar from moving to the unlocked position unless the plurality of side pins are in predetermined positions aligning the recesses on the side pins with the ridge.

17. A key in combination with a lock assembly adapted to actuate the lock assembly, the lock assembly including:

a shell having an inner surface and a locking groove longitudinally formed therein;

a key plug fitted within the shell for rotational motion therein, the key plug having a front surface and an exterior surface defining a shear surface with the inner surface of the shell;

a key slot extending from the front surface of the key plug longitudinally into the key plug;

a plurality of top pin bores extending from the shell across the shear surface and into the key plug;

a plurality of top pins having an upper half and a lower half located in corresponding top pin bores;

a plurality of top pin springs located in corresponding top pin bores and urging the top pins across the shear surface to prevent rotation of the key plug when a key is not in the key slot;

a plurality of side pin bores in the key plug extending into the key slot;

a plurality of side pins having an exterior surface with a recess formed therein, the side pins being fitted within corresponding side pin bores for sliding motion therein;

a locking bar slideway formed in the key plug extending from the exterior surface of the key plug to the side pin bores; and a locking bar having a ridge, the locking bar being held in the locking bar slideway for motion perpendicular to the locking groove between a locked position in which the locking bar extends into the locking groove and an unlocked position in which the ridge enters the recesses in the side pins, the ridge preventing the locking bar from moving to the unlocked position unless the plurality of side pins are in predetermined positions aligning the recesses on the side pins with the ridge;

the key comprising:

a key bow for rotating the key;

a key blade having a plurality of notches adapted to contact the top pins and align the lower half of the top pin in the key plug and the upper half of the top pin in the shell and a plurality of depressions of varying depths adapted to contact the side pins and move the side pins to the predetermined positions aligning the recesses on the side pins with the ridge on the locking bar.

18. A key according to claim 17 wherein the key blade includes a plurality of wards extending longitudinally along the key shaped to allow the key to enter the key slot.

19. A key according to claim 17 wherein the key blade includes an upper half and a lower half, the upper half having the plurality of notches formed thereon and the lower half having the plurality of depressions formed thereon.

20. A key according to claim 19 wherein the plurality of depressions formed on the lower half of the key blade are formed on a first side of the key blade and the opposite side of the lower half of the key blade includes a second plurality of depressions adapted to contact a second plurality of side pins.

* * * * *

UNITED STATES PATENT AND TRADEMARK OFFICE

CERTIFICATE OF CORRECTION

PATENT NO. : 5,475,998

DATED : December 19, 1995

INVENTOR(S) : Raskevicius et al.

It is certified that error appears in the above-identified patent and that said Letters Patent is hereby corrected as shown below:

Column 4, Line 18: "tile" should read - - the - -.

Column 5, Line 49: "48" should read - - 49 - -.

Signed and Sealed this

Thirtieth Day of April, 1996

Bruce Lehman

*Attest:*

BRUCE LEHMAN

*Attesting Officer*

*Commissioner of Patents and Trademarks*